US005317796A

United States Patent [19]

Hunter

[11] Patent Number: 5,317,796

[45] Date of Patent: Jun. 7, 1994

[54] TECHNIQUE FOR RENDERING PACKAGING CHILD RESISTANT

[76] Inventor: Robert M. Hunter, 320 S. Willson Ave., Bozeman, Mont. 59715

[21] Appl. No.: 437,656

[22] Filed: Nov. 15, 1989

Related U.S. Application Data

[63] Continuation-in-part of Ser. No. 339,819, Apr. 18, 1989, Pat. No. 4,991,729.

[51] Int. Cl.[5] ..... B23P 11/00; B65D 55/02

[52] U.S. Cl. ..... 29/434; 215/206; 215/223

[58] Field of Search ..... 215/202, 206, 208, 201, 215/223, 329; 264/239, 241

[56] References Cited

U.S. PATENT DOCUMENTS

| | | | |
|---|---|---|---|
| 446,657 | 2/1981 | Baum . | |
| 841,668 | 1/1907 | Cowles . | |
| 2,947,431 | 8/1960 | Haynes | 215/208 |
| 3,033,406 | 9/1960 | Sauber | 215/9 |
| 3,129,834 | 12/1961 | Kimball | 215/9 |
| 3,212,662 | 10/1965 | Webb | 215/208 |
| 3,405,828 | 3/1967 | St. Pierre | 215/9 |
| 3,407,954 | 8/1966 | Millis | 215/9 |
| 3,421,347 | 4/1967 | Sotory | 70/63 |
| 3,422,977 | 1/1969 | Shaw | 215/208 |
| 3,445,021 | 6/1967 | Johnson | 215/9 |
| 3,451,576 | 6/1969 | Lewis | 215/208 X |
| 3,472,410 | 10/1969 | Turner | 215/206 |
| 3,656,647 | 4/1972 | Swinn | 215/206 X |
| 3,669,296 | 6/1972 | Drew et al. | 215/9 |
| 3,684,117 | 8/1972 | Leopoldi et al. | 215/9 |
| 3,771,682 | 11/1973 | Chacos | 215/208 |
| 3,824,815 | 7/1974 | Darling | 215/208 X |
| 3,843,007 | 10/1974 | Meyer | 215/206 |
| 3,850,324 | 11/1974 | Meyer | 215/206 |
| 4,071,156 | 1/1978 | Lowe | 215/224 |
| 4,249,806 | 2/1981 | Tokhadze | 353/30 |
| 4,385,705 | 5/1983 | Kusz | 215/220 |
| 4,497,094 | 2/1985 | Morris | 24/633 |
| 4,502,194 | 3/1985 | Morris et al. | 24/633 |
| 4,546,434 | 10/1985 | Gioello | 364/300 |
| 4,649,497 | 3/1987 | Carlson et al. | 364/491 |
| 4,697,722 | 10/1987 | Saito et al. | 222/571 |
| 4,749,038 | 6/1988 | Shelley | 166/250 |
| 4,752,887 | 6/1988 | Kuwahara | 364/491 |
| 4,782,963 | 11/1988 | Hunter | 215/206 |
| 4,799,388 | 1/1989 | Hunter | 73/861.63 |
| 4,810,661 | 3/1989 | Yamazaki | 437/3 |
| 4,814,283 | 3/1989 | Temple et al. | 437/8 |
| 4,817,005 | 3/1989 | Kubota et al. | 364/468 |
| 4,868,980 | 9/1989 | Miller, Jr. | 29/850 |
| 4,896,542 | 1/1990 | Hunter | 73/861.63 |
| 4,902,020 | 2/1990 | Auxier | 273/256 |
| 4,917,073 | 4/1990 | Duret | 123/73 C |

OTHER PUBLICATIONS

Hunter et al., Cognitive Skill Based Child-Resistant Medicine Container, Jan. 30, 1989, pp. 44–93.

*Primary Examiner*—Allan N. Shoap
*Assistant Examiner*—Vanessa Caretto

[57] ABSTRACT

Packaging having a combination lock closure is rendered child resistant in a manner that maintains ease of adult use and economy of manufacture while providing adequate protection of child health. The technique comprises the steps of selecting an appropriate child resistance effectiveness, selecting an appropriate older adult use effectiveness, determining a probability of random opening that correlates with the selected child resistances effectiveness and provides at least the selected older adult use effectiveness, and configuring the combination lock closure to present to the package user said probability of random opening. Configuring the closure may include providing a plurality of tumblers, only one of which is accessible to manual manipulation.

7 Claims, 3 Drawing Sheets

TECHNIQUE FOR RENDERING PACKAGING CHILD RESISTANT

This invention was made with Government support under Grant No. 1 R43 HD24009-01 awarded by the National Institutes of Health. The Government has certain rights in the invention.

The present application is a continuation in part of copending application Ser. No. 339,819 filed Apr. 18, 1989, now U.S. Pat. No. 4,991,729 and entitled ELDER-ACCESSIBLE CHILD-RESISTANT PACKAGING.

This application discloses techniques that were discovered during research funded by the United States Department of Health and Human Service—National Institute of Child Health and Human Development (NICHD) under the Small Business Innovative Research Program. The invention is described in detail in a report entitled "Cognitive Skill Based Child-Resistant Medicine Container" prepared for the NICHD by Yellowstone Environmental Science, Bozeman, Mont., January, 1989.

The present invention relates to techniques for rendering packaging child resistant while maintaining ease of adult use. In particular, the present invention relates to techniques for making packaging having combination lock closures sufficiently child resistant to provide adequate protection of child health yet not so complex as to be uneconomical or excessively inconvenient for adults.

THE STATE OF THE ART

A child-resistant package is essentially a locked package having a "key" that adults possess and children do not. Most child-resistant packaging (CRP) on the market today relies on "locks" that have both cognitive skill and strength or dexterity based "keys". This type of CRP is generally inaccessible by older adults. Other types of CRP utilize actual keys, but are less practical.

CRP with locking mechanisms that do not rely on actual keys or on presumed strength or dexterity differences between children and adults are also possible. These types of CRP are cognitive skill based, that is, they rely on cognitive skills that adults possess and children under the age of five do not, e.g., problem-solving skills. Cognitive skill based CRP proposed to date rely on combination lock mechanisms, maze closures, dual (or reverse) thread closures or a combination of these technologies.

Combination lock mechanisms appropriate for providing child resistance for packages are of two basic types. With one type, the mechanical elements that maintain the locked condition are directly manipulated (actually touched) by the user. The puzzle-lock (also known as the letter-lock or ring-lock) is the classic example of this type.

With the second basic type of combination lock, at least some of the mechanical elements that maintain the locked condition are manipulated indirectly. With this type of lock, only one locking element need be directly moved and it, in turn, moves (usually rotates) either one (directly) or all (some indirectly) of the other locking elements (usually tumblers).

The second type of cognitive skill based CRP closure is the maze closure or dual thread closure. With this type of closure, two types of motion are required for closure unlocking: (1) rotation and (2) linear (usually axial) motion. The sequence of steps required to unlock the closure typically consists of alternating rotations with axial motions. True combination lock closures can be differentiated from maze and dual thread closures in that unlocking of combination lock closures requires only one type of motion, e.g., rotation or linear motion. Combination lock closures that rely on rotation(s) for unlocking may allow axial motion between the closure cap and the container prior to unlocking, but this second type of motion does not cause (and may even prevent, in some designs) unlocking of the closure mechanism.

A significant limitation of maze closures and dual thread closures has been their loss of oxygen and moisture exclusion and (liquid, powder or granule) content inclusion capabilities upon partial opening. Another problem with dual thread closures is that they are reportedly not very difficult for children to open. A third limitation of the dual thread closures is that opening them requires an action (unscrewing a left hand thread) that is unfamiliar to adults and that, in fact, goes against decades of experience in how a threaded closure is opened.

Child-resistant packaging designs having combination lock closures of the first type have been disclosed by a number of inventors. U.S. Pat. Nos. disclosing such inventions include those issued to Baum (446,657), Cowles (841,668), Sauber (3,033,406), Kimball (3,129,834), St. Pierre (3,405,828), Millis (3,407,954), Sotory (3,421,347), Johnson (3,445,021), Drew et al. (3,669,296), Leopoldi et al. (3,684,117), Meyer (3,843,007) and Meyer (3,850,324). The designs have not achieved commercial success because they are, in effect, too child resistant or too complex or both. They generally comprise multiple movable parts and, as a consequence, have a higher manufacturing cost and present a higher level of complexity to the user. The child resistance provided by such package designs is in excess of that required to adequately protect children and the structures required to provide this level of child resistance generally make them difficult for adults to use and uneconomic.

Under current and proposed regulations of the U.S. Consumer Product Safety Commission (CPSC), child-resistance effectiveness (CRE) and older adult use effectiveness (OAUE) of CRP designs are measured using standard test protocols. CRE is measured by asking pairs of children in a specified age group (generally under five years of age) to attempt to open the package in specified time periods both before and after a nonverbal demonstration. The CRE is the fraction of children in the group (expressed as a percentage) that is unable to open the package. OAUE is measured by asking individual adults in a specified age group to open and close the package using the instructions supplied with it within a specified time period. The OAUE is the fraction of adults in the group that is able to open and close the package.

Thus, in the United States, CRP must meet specified criteria for child resistance effectiveness and adult use effectiveness. Moreover, these criteria are subject to change over time. Prior art combination lock CRP designs were not based on a technique for rendering packaging child resistant that allowed cost-effective compliance with current and proposed CPSC regulations.

THE NATURE OF THE PRESENT INVENTION

The present invention provides a technique for rendering packaging child resistant while maintaining ease of adult use and low cost of manufacture. The technique can be applied to closures whose use requires adults to perform a simple combination of moves to either remove the closure or otherwise gain access to container contents.

Such packaging designs rely for their effectiveness on cognitive skill differences between young children and adults. They pose a problem that adults can solve and that young children cannot. Young children typically do not use the "scientific method" in solving problems, that is, they do not generate and test hypotheses related to solution of the problems they face. In fact, the problem-solving behavior of young children exhibits a "win-shift" pattern. A child will attempt incorrect "solutions" repeatedly and only shift to a correct solution after it is found by accident. This type of problem-solving behavior is consistent with a "zero-memory assumption" in that young children act as if they do not remember that a particular "solution" is incorrect. Thus, child-resistance can be provided by presenting a young child with a problem having many incorrect "solutions" and only one correct one. Optimally, the incorrect "solutions" have a similar appearance to the correct solution.

CRP can be configured to exploit this opportunity by designing the package closure means along the line of a combination lock mechanism having a known probability of random opening. This allows the closure to be designed to provide a measurable degree of resistance to opening by random manipulations of the closure. Closure designs can be optimized by reducing closure complexity (and, therefore, cost) to the minimum level required to meet government regulations for child resistance or market demands. Furthermore, closure designs can be optimized by providing a level of complexity that does not reduce elder accessibility below acceptable levels.

In its broadest sense, the invention is a technique for rendering children resistant a package having a combination lock closure mechanism, the method comprising the steps of selecting an appropriate level of child resistance, using the selected level of child resistance to determine a probability of random opening with which it correlates, and configuring a closure mechanism with the determined probability of random opening. The closure mechanism comprises fastening means on a container part and fastening means on a closure part and one or more tumblers movably attached to one of the two parts.

The best mode involves selection of a level of child resistance that provides a CRE and an OAUE equal to that required by government regulations. Currently, in the United States regulations of the CPSC require a CRE of 85 percent before a demonstration and 80 percent after one. An OAUE of 90 percent has been proposed.

Analysis of the findings of research described in the document first referenced above and research conducted by the CPSC have shown that correlations exists between the probability of random opening (PRO) of a closure and its CRE and between the PRO of a closure and its OAUE. The present invention is disclosed hereinafter by first describing the general configuration, structure and mode of operation of a CRP design having a combination lock closure and then explaining the technique used to further configure and dimension the closure using the findings of the above research to optimally provide CRE and OAUE. While the preferred mode of combination lock closure comprises the second basic type of combination lock described above, the method is applicable to both basic types.

It is an object of the invention to provide a technique for rendering packaging child resistant. It is a further object of the invention to provide a technique for rendering packaging child resistant while maintaining ease of adult use and economy. Further objects and advantages of my invention will become apparent from a consideration of the drawings and ensuing description of it.

DRAWINGS SHOWING PREFERRED EMBODIMENT OF THE INVENTION

DETAILED DESCRIPTION OF THE DRAWINGS

Figure 1:
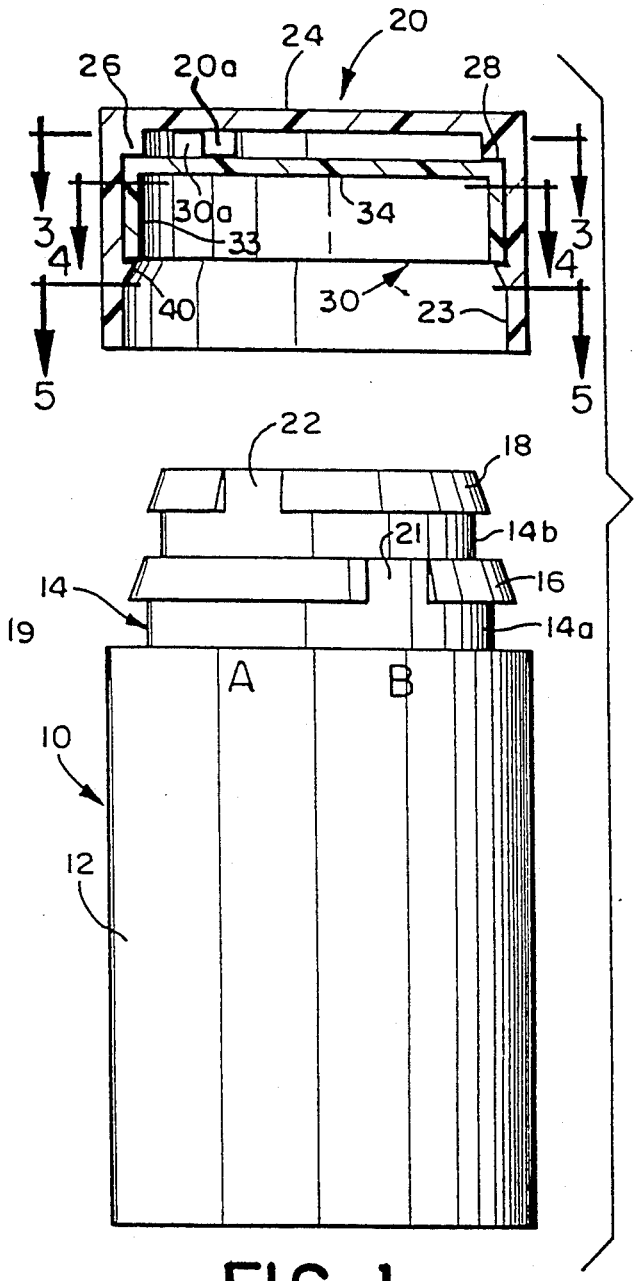
FIG. 1 is a side elevational view of a container and a closure cap supporting a relatively rotatable member with the closure cap removed and spaced from the container, shown in section.

Referring first to FIG. 1, there is illustrated a container, generally designated 10 , for example, a pill bottle. The body portion of the container may be blow molded or otherwise conventionally fabricated of moldable resinous material and may be of any shape and dimensions provided it is terminated in a neck 14 of cylindrical form, through which is provided an open mouth access to the body 12 of the container 10. In this embodiment the neck is stepped from a larger diameter portion **14*a* to a smaller diameter portion 14*b* at the mouth opening. On the outer surface of the neck are molded or otherwise provided fastening means in the form of circumferential ribs 16 and 18 which are preferably arranged near the top of the respective cylindrical section. Each of the ribs 16,18 is provided with a discontinuity or channel 21,22** of sufficient width to permit passage of a stud, a cooperating fastening means as described below. Although they may vary in specific geometry and axial length, as well as cross-sectional shape, a preferred cross section shape for the ribs is triangular or beveled increasing in thickness in the direction away from the mouth. In some versions such a form permits the studs of the cap to be snapped over the ribs as the closure cap is placed onto the container.

Considering now the closure cap 20, the structure includes sidewalls 23 and closing end wall or top 24. The sidewalls provide a generally cylindrical internal surface whose diameter is considerably larger than the larger diameter portion **14*a* of the neck 14 of the container. In this particular embodiment the sidewalls 23 are thickened in the region 26 adjacent the end wall 24 to provide a shoulder 28 which acts as a spacer bearing for a nested rotatable member 30, also of cap form in this embodiment, rotatable relative to the closure cap 20. Shoulder 28 spaces rotatable member 30 at least a sufficient distance axially from the end wall 24 to accommodate interfering stops 20***a* and 30*a*. Stop 20*a* extends down from the top 24 of closure cap 20 and radially inward from the thickened wall region 26 and stop 30*a* extends up from the top 34 of rotatable member 30 inset from the edge so as to clear wall region 26 yet make contact with stop 20*a*. Single stops 20*a* and 30*a* on closure cap 20 and rotatable member 30 permit a large part of a full rotation of the rotatable member 30 relative to closure cap 20. At least one inwardly projecting stud 38 is provided on the inner cylindrical surface of sidewall 23 of closure cap 20. Similarly at least one inwardly projecting stud 36 is provided on inner wall 33 of rotatable member 30. The studs are of a width to pass through channels 21 and 22, respectively, and are so positioned on walls 23 and 33 as to lie below ribs 18 and 16 when the top 34 of rotatable member 30 is in place over the neck of the container. Although they may vary in specific geometry and axial length, as well as cross-sectional shape, a preferred cross section shape for the studs 36 and 38 is triangular or beveled increasing in thickness in the direction toward the tops 34 and 24. In some versions such a form permits the studs to be snapped over the ribs as the closure cap is placed onto the container. In other versions, in order to be able to insert the container neck into the cap, the studs may be properly indexed relative to one another, which occurs when the closure cap 20 is rotated relative to the rotatable member 30 to a predetermined position. In this position the angular circumferential spacing between the studs 36 and 38 corresponds to that of channels 21 and 22 so that when the studs are aligned with the channels and allow axial movement of the cap 20 onto the container to close the container. Then when the closure cap is turned relative to the container sufficiently for stops 20*a* and 30*a* to interact and turn the rotatable member relative to the container, the studs will underlie the respective ribs 18 and 16 keeping the closure cap in place.

In practice the rotatable member 30 is loosely held in the closure cap 20 by a small retainer ring 40 past which the rotatable member is forced in assembly. The loose fit is designed into the structure just as a snug fit is designed between part of the sidewalls 33 of the rotatable member 30 and neck 14*b*, or more precisely rib 18 is. The sidewalls 33 of the rotatable member 30 may be tapered or flared out very slightly so that clearance decreases between the rib 18 and the sidewalls 33 of rotatable member 30 as the closure cap 20 is moved into place so that some part of the neck portion 14*b*, here rib 18, frictionally engages the sidewalls 33. Alternatively, sidewalls 33 may be designed to deform in shape and/or circumferential length to provide a snap fit. Other methods of accomplishing such a frictional engagement are disclosed in the inventor's U.S. Pat. No. 4,782,963. This has the effect of better closing the container as well as causing the relatively rotatable member 30 not to rotate with the closure cap but to stay with the body 12 of container 10 during relative rotation until the stops 20*a* and 30*a* make contact. At that point the closure cap 20 will drive the rotatable member 30 by means of the stops and against the frictional force.

Figure 3:
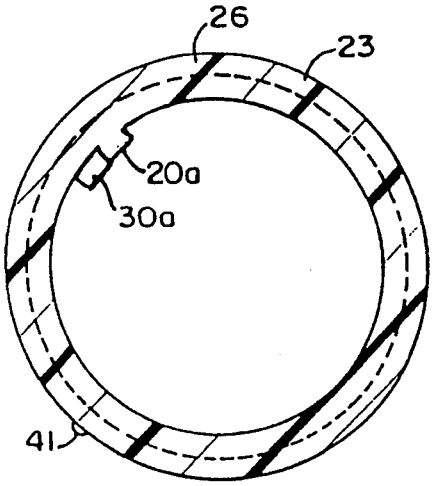
FIG. 3 is a sectional view taken along line 3—3 of FIG. 1.
Figure 4:
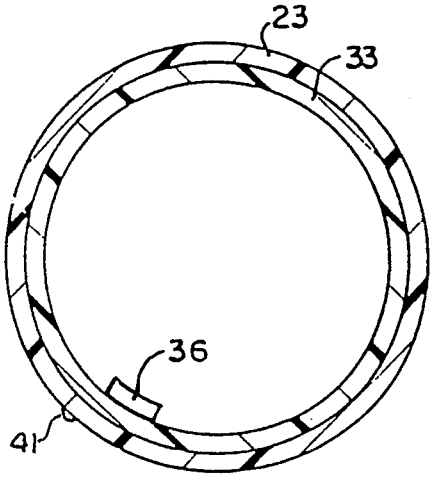
FIG. 4 is a sectional view taken along line 4—4 of FIG. 1.
Figure 5:
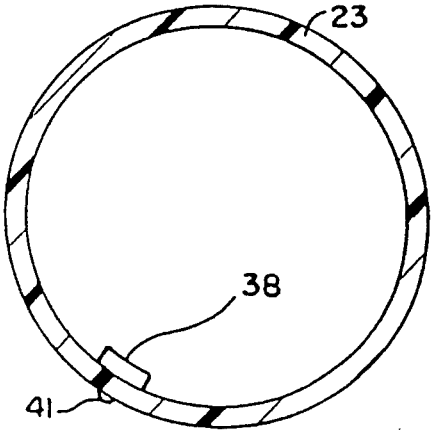
FIG. 5 is a sectional view taken along line 5—5 of FIG. 1.
Figure 2:
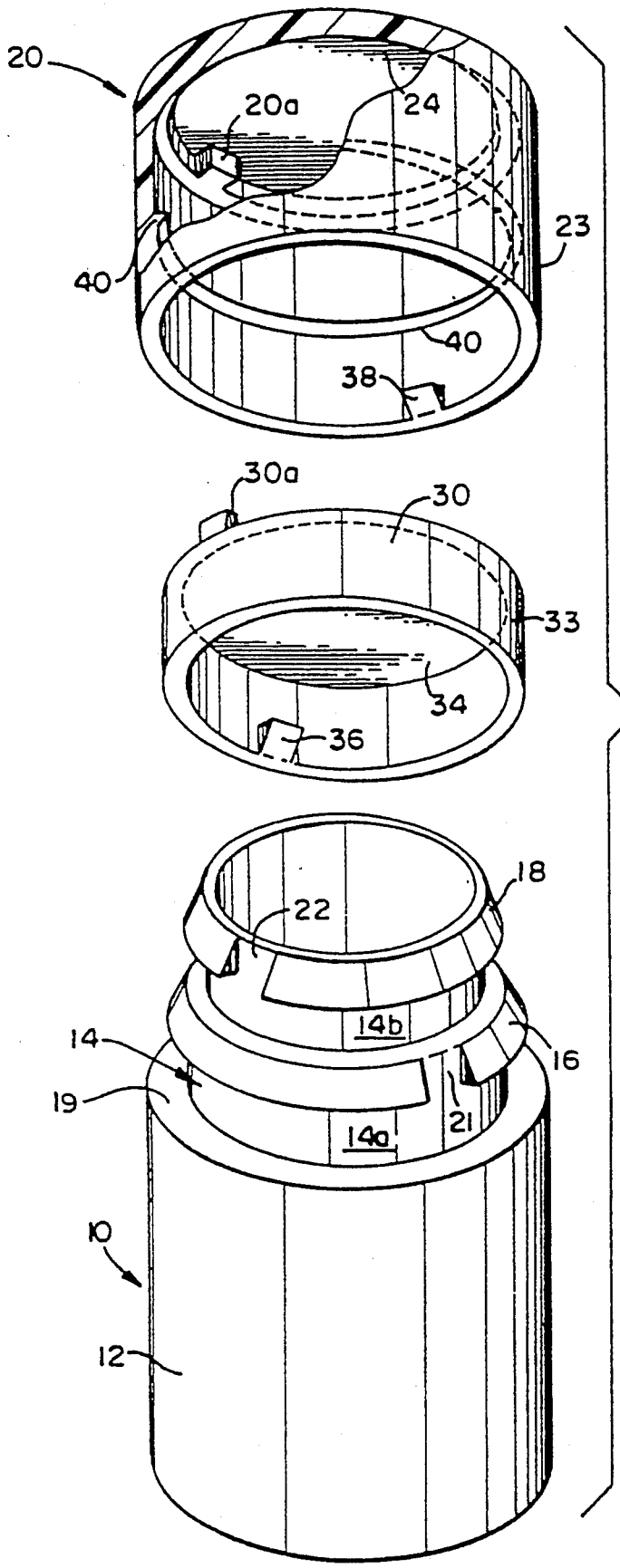
FIG. 2 is an exploded perspective view of the container and closure cap of FIG. 1 showing the rotatable member separated from the closure cap structure.

For a better understanding of the cooperation between the rotatable member 30 and the closure cap 20 reference is made to FIGS. 3, 4 and 5, as wells as FIGS. 1 and 2. FIG. 2 shows the closure cap structure in an exploded view with part of the closure cap broken away so that structure of closure cap 20 and relatively rotatable member 30 can be seen in greater structural detail. In FIG. 2, the perspective in the container is looking down, whereas the perspective on the cap and rotatable members is looking up. As seen in FIG. 2, this particular embodiment of the invention employs a single stud 36 on sidewalls 33. Closure cap 30 carries a similar single stud 38 circumferentially offset from stud 36 when the closure is in the open or unlocked position.

In other variations of this embodiment there can be multiple studs, for example, corresponding to each stud cooperating with channels correspondingly spaced on the neck. A single stud can, of course, also be used with a plurality of channels to provide multiple opening positions should that be desired. Alternatively, a plurality of studs may be provided only one of which is small enough to pass through a channel so that at least one stud must be resiliently snapped over the rib in placing the closure cap on the neck. Closure removal then is accomplished matching at least one stud with a channel and rocking the cap to snap at least one other stud past the rib or, alternatively, by snapping all of the other studs past the rib.

In most embodiments a stud need not be of great length, but its width must be dimensioned to pass through channels 21 or 22. The upper surface 34 of rotatable member 30 abuts bearing shoulder 28 on closure cap 20. The shoulder 28 positions and in assembly limits the inward movement of the rotatable member 30. In other arrangements circumferentially spaced posts on either closure cap or rotatable member could serve the same purpose as axial stops.

Assuming that the closure cap is on the container and one wishes to remove it, it is convenient to provide markings on the container and closure cap to enable realignment of the studs and channels. The markings may be printed in contrasting color using a relatively large typeface such as Helvetica 12 point. Alternatively, they may also be raised or embossed and/or printed with a phosphorescent ink to allow their recognition and use in the dark. Here they are shown on FIGS. 1–5 as the black letters A and B on the white container 10 and an embossed black line or arrow 41 on the closure cap 20. First the closure cap is rotated a full rotation counterclockwise to achieve indexing contact between stops 20*a* and 30*a*, rotating rotatable member and stopping the arrow at the letter A. This aligns stud 36 with channel 22 which is, the illustrated condition. Then rotation in the opposite direction to position B will position stud 38 to pass axially through channel 21. In this embodiment, the embossed black line, or arrow 41 and the black letter A comprise a first set of marks and the embossed black line or arrow 41 and the black letter B comprise a second set of marks.

FIG. 1 shows rotatable member 30 held in closure cap 20 by retainer ring 40 such that relative axial movement of rotatable member 30 in closure cap 20 is prevented. Similarly, the axial dimensions of the closure cap sidewalls and container neck, as well as the locations of stud 38 and rib 16 are such that axial movement of closure cap 20 is effectively prevented when the closure is in the locked condition. Thus only one type of relative movement, rotation, both of the rotatable member 30 and closure cap 20 relative to container 10 is possible when the closure is locked.

Although the embodiments described above are provided with a single stud on the closure cap and a single stud on the rotatable member, a plurality of studs could be provided on each. If a plurality of studs (for example, three) and only a single channel in each rib are provided, then at least one of the studs on both the closure cap and the rotatable member must be sized to permit passage through the appropriate channel. Alternatively, all of the studs may be so sized. Of course, the closure cap and rotatable part may be provided with different numbers of studs or channels.

Combination lock mechanisms can be unlocked either by random or systematic attempts to try different combinations. Combination lock mechanisms used on prior art CRP typically present the adult user with a straightforward number of possible combinations for unlocking the closure. They usually did this by providing a single index mark on the cap and a plurality of numbers or letters on each tumbler. The closure was unlocked by aligning an appropriate number or letter on each tumbler with the single index mark. Rotation of a tumbler to a position wherein the single index mark was not aligned with a number or letter on the tumbler was not an option for unlocking the closure.

The combination lock mechanisms disclosed in the inventor's above-referenced patent and in FIGS. 1–5 do not present the adult users with a straight-forward, discrete number of possible combinations. This is the case because the relative direction of the tumbler rotations is significant, which is not true with puzzle-lock type designs.

Because young children are incapable of systematic attempts to try different combinations, both closures having a discrete number of possible combinations and those that do not can be analyzed using the laws of probability to assess the potential unauthorized opening by a child. For the purposes of this disclosure, the potential for unauthorized opening by a child is termed the probability of random opening (PRO). The PRO of any combination lock mechanism is estimated in a similar manner. In general, the PRO of CRP is the product of the individual probabilities that each tumbler could be randomly moved to its unlocked position. The individual probability that a tumbler could be randomly moved to its unlocked position is the probability that its fastening means could be randomly moved to the unlocked position for that tumbler. This probability is generally calculated by multiplying the placement quotient by the direction quotient. The placement quotient is estimated by dividing the number of possible positions that a tumbler can take and be in the unlocked condition by the total possible positions for that tumbler. The direction quotient is 1.0 if the direction the tumbler is moved is unimportant. If the direction is important, it is calculated by dividing the number of correction directions by the total possible directions it can be moved. An estimate of this probability is calculated for the embodiment disclosed herein by multiplying the following: (1) the probability that the center of the stud(s) on each movable part (i.e., tumbler) could be randomly placed within the "effective width" of a channel and (2) the probability that each tumbler could be randomly rotated in the correct direction.

The first probability is estimated for each tumbler by dividing the total combined "effective widths" of the channels (assuming the channels are equally spaced) by the interior circumference of the tumbler. The "effective width" for each channel is calculated by subtracting the stud width (SW) from the channel width (CW). The second probability is estimated by dividing the number of correct directions the closure should be rotated (typically one) by the total number of directions the closure could be rotated (usually two). The above are determined for each tumbler, i.e., each movable part having channels requiring alignment for the closure to be unlocked, and then all probabilities so estimated are multiplied. For example, a closure design with a 2.0 inch diameter closure cap (which is a first tumbler) with one 1.5 inch diameter rotatable member (which is a second tumbler), 0.25 inch wide studs (one on each tumbler), 0.375 inch wide channels (one on each tumbler), and only one correct direction for the second rotation, the probability of random opening is as follows:

$$(0.125/4.712)(0.125/6.283)(0.5)=0.000264$$

Research conducted by the CPSC and research described in the document referenced above have shown that there are approximate correlations between the calculated PRO of a combination lock CRP closure and its CRE and between its PRO and its OAUE. Approximate correlations developed to date are presented in FIG. 6. As more data on CRE and OAUE are correlated with the calculated PRO of such closures, packaging engineers will be able to more accurately predict the CRE and OAUE ratings of cognitive skill based CRP designs in advance of protocol testing. This will enable such engineers to more efficiently optimize CRP designs in response to changes in government regulations or the demands of the market. The correlations shown in FIG. 6 can, however, be used at present in the United States to determine a probability of random opening that provides at least a selected CRE and/or at least a selected OAUE.

In order to practice the method of rendering a package child resistant disclosed herein, the first step is to select an appropriate CRE. A minimum CRE may be mandated by government regulations as it is in the United States or it may be demanded by users. A second (optional) step is to select an appropriate OAUE. This step may not be necessary in situations where OAUE is not required by government regulations or the market.

Figure 6:
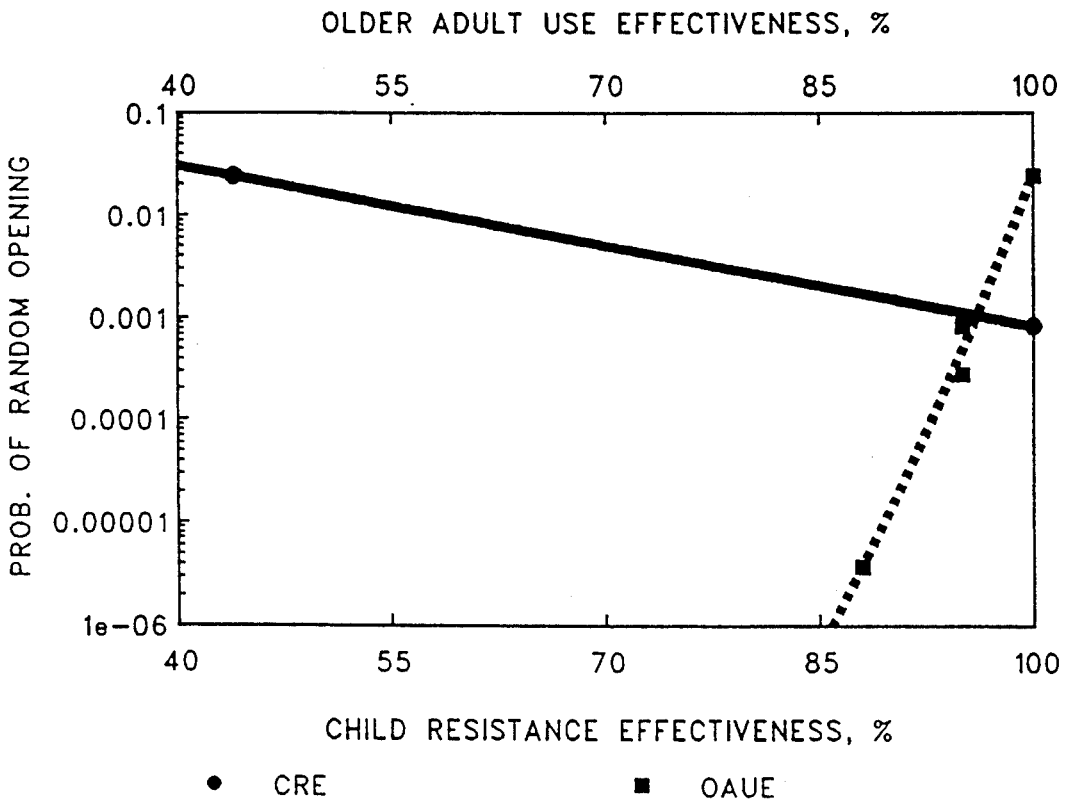
FIG. 6 illustrates correlations between PRO and CRE and between PRO and OAUE.

The next step is to determine a PRO that correlates with at least the selected CRE and, optionally, with the selected OAUE. FIG. 6 may be used in this determination in the absence of other data. For example, FIG. 6 is entered with the selected CRE, say 80 percent, and a PRO of about 0.002 is determined.

The final step is to configure the combination lock mechanism to have the PRO determined in the prior step. With closures requiring rotations for unlocking, this is accomplished by providing the closure an appropriate number of tumblers, each tumbler having an appropriate "effective width" of channel in relation to the stud width and an appropriate interior circumference.

The method is illustrated in the following example. In this example, a CRE of 85 percent and an OAUE of at least 90 percent are selected. These values are consistent with the current and proposed regulations of the CPSC. FIG. 6 is entered (at the abscissa axis or x-axis) and the CRE correlates with a PRO (read on the ordinate axis or y-axis) of 0.002 and the OAUE correlates with a PRO of at least 0.0005. Thus, a PRO of 0.002 is determined.

A PRO of 0.002 can be achieved with a closure design of the type illustrated in FIGS. 1-5. Review of the illustrated design indicates that while closure cap 20 can be rotated in either direction to align stud 36 with channel 22, closure cap 20 must be rotated in the opposite direction to align stud 38 with channel 21 if the previous alignment of stud 36 with channel 22 is to be maintained. Thus, the probability that the first tumbler (rotatable member 30) could be randomly rotated in the correct direction is 1.0, but the probability that the second tumbler (closure cap 20) could be randomly rotated in the correct direction is 0.5.

Many commercial snap-on type CRP closure caps incorporate a stud having a stud width (SW) of about 0.1875 inch. Two common CRP closure sizes are 33 millimeter (1.30 inches) and 38 millimeter (1.50 inches) in diameter. They are appropriate sizes for use on each neck step on small containers having a stepped neck such the container shown in FIGS. 1 and 2. If these closure sizes are used, the corresponding interior diameters of the first tumbler (rotatable member 30) is about 1.30 inches and the interior diameter of the second tumbler (closure cap 20) is about 1.50 inches. The corresponding interior circumferences of the tumblers (IC) are about 4.08 inches and about 4.71 inches, respectively. If a single channel is provided in each rib 16 and 18 and the channels are equal in width, then the probability (P) that the center of each stud could be randomly placed within the "effective width" (EW) of each channel is:

$$P=EW/IC$$

where $$EW=CW-SW$$

With a common stud width (SW) of about 0.1875 inch and a PRO of 0.002, an appropriate channel width (CW) is:

$$0.002=[(CW-0.1875)/4.08]*1.0*[(CW-0.1875)/4.71]*0.5$$

or $$0.0769=CW-0.1875$$

or $$CW=0.264 \text{ inch}$$

Thus, a combination lock closure mechanism of the type illustrated in FIGS. 1-5 configured with the above dimensions has a CRE of 85 percent and an OAUE of at least 90 percent.

Many variations of the invention will occur to those skilled in the art. All such variations within the scope of the claims are intended to be within the scope and spirit of the invention. For example, while the tumblers used in the examples disclosed herein have studs as fastening means, the method is also applicable to tumblers having notches or channels as fastening means. Furthermore, while the tumblers used in the examples disclosed herein are rotatable members, the method is also applicable to tumblers that are slidable members.

As another example, while the correlations presented in FIG. 6 are appropriate for use at present with American children other correlations may be appropriate for other times and places. Those skilled in the art will see that simple experiments can be used to develop such correlations in other situations. For example, a CRP design similar to the embodiment disclosed in FIGS. 1-5 could be easily modified by gradually increasing the "effective width" of its channels (and, hence, by increasing its PRO) and then testing the modified embodiments on small groups of children and older adults using the CPSC test protocol. Each experiment would produce a point on a correlation graph.

I claim:

1. A method for rendering a package child resistant, said package having a combination lock closure, comprising the steps of:

selecting an appropriate child resistance effectiveness, determining a probability of random opening that provides at least said child resistance effectiveness by reference to a means for relating the child resistance effectiveness of combination lock closures to the probability of random opening of said closures, and configuring said combination lock closure to have said probability of random opening.

2. A method for rendering a package child resistant, said package having a combination lock closure, comprising the steps of:

selecting an appropriate child resistance effectiveness, selecting an appropriate older adult use effectiveness, determining a probability of random opening that correlates with the selected child resistance effectiveness by reference to a means for relating the child resistance effectiveness of combination lock closures to the probability of random opening of said closures, and provides at least the selected older adult use effectiveness by reference to a means for relating the older adult use effectiveness of combination lock closures to the probability of random opening of said closures, and configuring said combination lock closure to present to a package user said probability of random opening.

3. A method as in claim 1 or 2 wherein configuring said combination lock closure comprises:

forming at least a portion of a container to provide an interior, an opening, and fastening means, forming a first tumbler adapted to fit over said opening, said first tumbler having fastening means and being accessible to direct manual manipulation, and forming a second tumbler adapted to fit between said container and said first tumbler, said second tumbler having fastening means and being inaccessible to direct manual manipulation.

4. A method as in claim 3 wherein the probability of the tumblers being randomly moved to a single combination of positions that allows access to said interior of said container is at most 0.001.

5. A method as in claim 1 or 2 wherein configuring said combination lock closure comprises:

forming at least a portion of a container to provide an opening and container fastening means, forming first movable closure part adapted to fit over said opening and having closure fastening means engagable with the container fastening means, and forming second movable closure part adapted to fit between said first movable closure part and said container when said first movable closure part is covering said opening, and said second movable closure part having closure fastening means engagable with said container fastening means;

the movable closure parts being capable of movement relative to said container to a plurality of combinations of locked positions that prevent access to be gained to the contents of said container and to a single combination of unlocked positions that allows access to be gained to said contents;

said second movable closure part being inaccessible to direct manual manipulation and being indirectly moved to its unlocked position by relative movement of said first movable closure part and said container;

wherein the probability of said movable parts being randomly moved to said single combination of unlocked positions is less than or equal to 0.002.

6. A method as in claim 1 or 2 wherein configuring said combination lock closure comprises:

forming at least a portion of a container to provide an opening, forming a closure cap for said opening, said closure cap being capable of movement relative to said container when the closure is in the locked, child-resistant condition, and forming a closure cap part and movably attaching said closure cap part to said closure cap, said closure cap part being movable with respect to both said container and said closure cap but inaccessible to direct manual manipulation when the closure is in the locked, child-resistant condition, wherein movement of said closure cap to a single combination of positions allows indirect movement of said closure cap part, unlocking of the closure and access to the container opening.

7. A method as in claim 1 or claim 2 wherein configuring said combination lock closure comprises:

forming at least a portion of a container to provide an opening, forming a closure cap for said opening, at least a portion of said closure cap being accessible to direct manual manipulation when the closure is locked over said opening, and forming a single, unthreaded closure cap part and movably attaching the closure cap part to said closure cap, said closure cap part being inaccessible to direct manual manipulation but movable by relative movement between said container and said closure cap when the closure is locked over said opening;

wherein said closure cap and said single, unthreaded closure cap part are capable of being moved to a plurality of combinations of positions when the closure is locked over said opening, only one combination of positions unlocking the closure and allowing access to the container opening.

* * * * *